US007971525B2

(12) United States Patent
Leins

(10) Patent No.: US 7,971,525 B2
(45) Date of Patent: Jul. 5, 2011

(54) DEVICE FOR ROTARY PROCESSING OF ROLLED MATERIALS

(75) Inventor: Reiner Leins, Albstadt (DE)

(73) Assignee: Blickle Sondermaschinen GmbH & Co. KG, Neufra (DE)

( * ) Notice: Subject to any disclaimer, the term of this patent is extended or adjusted under 35 U.S.C. 154(b) by 935 days.

(21) Appl. No.: 11/918,203

(22) PCT Filed: May 3, 2005

(86) PCT No.: PCT/DE2005/000815

§ 371 (c)(1),
(2), (4) Date: Oct. 10, 2007

(87) PCT Pub. No.: WO2006/116954

PCT Pub. Date: Nov. 9, 2006

(65) Prior Publication Data

US 2009/0107315 A1 Apr. 30, 2009

(51) Int. Cl.
*B41F 19/02* (2006.01)

(52) U.S. Cl. ..... 101/6; 101/216

(58) Field of Classification Search ..... 101/6, 216
See application file for complete search history.

(56) References Cited

U.S. PATENT DOCUMENTS

| | | | | |
|---|---|---|---|---|
| 4,436,249 | A * | 3/1984 | Santa Lucia et al. | 242/484.6 |
| 4,455,903 | A | 6/1984 | Kesten et al. | |
| 4,557,191 | A * | 12/1985 | Speicher | 101/4 |
| 5,188,027 | A * | 2/1993 | Fantoni | 101/216 |
| 5,507,228 | A | 4/1996 | Schulz et al. | |
| 6,085,650 | A | 7/2000 | Petersen et al. | |
| 6,259,837 | B1 * | 7/2001 | de Boer et al. | 385/24 |
| 6,318,257 | B1 * | 11/2001 | Niemiro et al. | 101/212 |
| 7,258,065 | B2 * | 8/2007 | Faist et al. | 101/216 |
| 2003/0047094 | A1 | 3/2003 | Niemiro et al. | |

FOREIGN PATENT DOCUMENTS

EP 0 947 717 A 10/1999

OTHER PUBLICATIONS

International Search Report.

* cited by examiner

*Primary Examiner* — Anthony H. Nguyen
(74) *Attorney, Agent, or Firm* — Collard & Roe, P.C.

(57) ABSTRACT

For a device (100 for rotary processing of rolled material capable of being conveyed along a transportation path between a rotatably mounted processing sleeve (110) and a rotatably mounted anvil sleeve (120), single-ended suspension of a processing axle (111) and an anvil axle (121) is achieved in that the anvil sleeve (120) rotatably mounted on the anvil axle (121) suspended at one end only is coupled to the anvil axle (121) by means of a bearing (122) mounted in a central region mid-way between the opposing edges (125, 126) of said anvil sleeve (120).

10 Claims, 5 Drawing Sheets

SECTION B-B

SECTION C-C

SECTION D-D

DETAIL E
5:1

DEVICE FOR ROTARY PROCESSING OF ROLLED MATERIALS

CROSS REFERENCE TO RELATED APPLICATIONS

Applicant claims priority under 35 U.S.C. §365 of PCT/DE2005/000815 filed May 3, 2005. The international application under PCT article 21(2) was not published in English.

The invention relates to a device for rotary processing of rolled materials capable of being conveyed along a transportation path between a rotatably mounted processing sleeve and a rotatably mounted anvil sleeve. The anvil sleeve usually acts as a counter bearing for the processing sleeve, to which pressure is applied. The cylindrical surface of the processing sleeve is profiled such that cutting, printing and embossing actions can be carried out, for example, depending on the task in hand.

Accordingly, devices of the aforementioned kind are usually used in the prior art to perform cutting, printing, and embossing processes. In similar devices disclosed in the prior art, the shafts or axles of the sleeves are suspended at both ends. This means that a suspension is provided near each of the two end faces of the shafts in order to ensure a constant contact pressure on the sleeves over their entire cylindrical surface. However, the disadvantage of such double-ended suspension of the shafts is that the replacement of one or more sleeves involves considerable consumption of effort and time. This in turn is associated with long machine outage times and usually also with down times of complete production lines comprising a sequence of processing machines. Single-ended suspension of the shafts or axles of the sleeves is not provided in conventional devices since this would result in an uneven distribution of the contact pressure between the sleeves.

It is therefore an object of the invention to provide a rotary processing device for rolled materials, in which device the processing shaft and the anvil axle together with the associated sleeves can be suspended at one end only while at the same time ensuring equal contact pressure of the sleeves over their entire cylindrical surface.

This object is achieved in a device of the afore-mentioned type by coupling the anvil sleeve, which is rotatably mounted on an anvil axle suspended at one end only, to the anvil axle by means of a bearing disposed in a central region midway between the opposing edges of the anvil sleeve.

Preferred embodiments of the invention form the subject matter of the dependent claims.

The combination of features of coupling the anvil sleeve, which is rotatably mounted on an anvil axle suspended at one end only, by means of a bearing disposed in a central region midway between the opposing edges of the anvil sleeve provides a device in which it is possible to achieve single-ended suspension of the rotatable processing shaft and the static anvil axle, since the central arrangement of the anvil bearing ensures equal contact pressure of the sleeves over their entire cylindrical surface.

According to a first preferred embodiment of the device of the invention, the anvil sleeve is coupled to a second bearing of the anvil axle, which second bearing is disposed in a region near a first edge of the anvil sleeve. The second bearing is preferably provided with a pivoting mechanism, which enables the anvil sleeve to pivot only toward the processing sleeve. The pivoting mechanism can comprise, for example, an oblong hole, which is oriented toward the processing sleeve and in which a pin connected to the anvil axle is mounted such that the two lateral surfaces of the pin are flush with the lateral surface of the oblong hole, but the top surface of the pin is free for movement such that the first edge of the anvil sleeve can move toward the processing sleeve. This makes it possible to resiliently intercept shocks occurring on the anvil sleeve or vibrations directed toward the processing sleeve with the help of the second anvil bearing, wherein the anvil sleeve is prevented from pivoting at right angles to said direction for the purpose of ensuring stability.

According to a particularly robust embodiment of the invention, the anvil sleeve can be coupled to a third bearing of the anvil axle, which third bearing is disposed in a region near a second edge of the anvil sleeve. Here again, the third bearing is preferably provided with a pivoting mechanism which enables the anvil sleeve to pivot only toward the processing sleeve. Here again, the swivel mechanism can comprise an oblong hole, which is oriented toward the processing sleeve, and in which a pin connected to the anvil axle is mounted such that the two lateral surfaces of the pin are flush with the lateral surfaces of the oblong hole, but the top surface of the pin is free for movement such that the second edge of the anvil sleeve can move toward the processing sleeve.

According to another preferred embodiment of the device of the invention, the processing sleeve is disposed on a processing shaft which can be driven by means of a motor device. However, in the device of the invention, the processing shaft is preferably, though not necessarily, suspended at one end only, and the anvil axle is preferably, though not necessarily, installed in a fixed position.

According to an important preferred embodiment of the device of the invention, the cylindrical surface of the processing shaft contains a cavity which is filled with a hydraulic fluid. The pressure of the hydraulic fluid against at least part of the cylindrical surface can be adjusted for the purpose of causing a reversible expansion of the diameter of the processing shaft, in order to allow for detachable mounting of the processing sleeve on the processing shaft. The pressure of the hydraulic fluid can be adjusted with a set screw, by means of which it is possible to change the unexpanded internal volume of the cavity filled with hydraulic fluid.

According to another preferred embodiment of the device of the invention, the unit consisting of the processing shaft and the processing sleeve is mounted for reciprocatory movement in the direction of the unit consisting of the anvil axle and the anvil sleeve. A relative movement of the unit consisting of the processing shaft and the processing sleeve in relation to the unit consisting of the anvil axle and the anvil sleeve can be controlled, preferably pneumatically.

The anvil sleeve is preferably driven by the processing sleeve, the processing sleeve being provided with a raceway in the region of its end face, which raceway can be brought into contact with the cylindrical surface of the anvil sleeve.

The processing sleeve can comprise, in the region of its cylindrical surface, for example, cutting, embossing, and printing elements for performing cutting, embossing, and printing processes of rolled materials respectively.

The device of the invention is described below with reference to a preferred embodiment shown in the figures of the drawings, in which.

Figure 1:
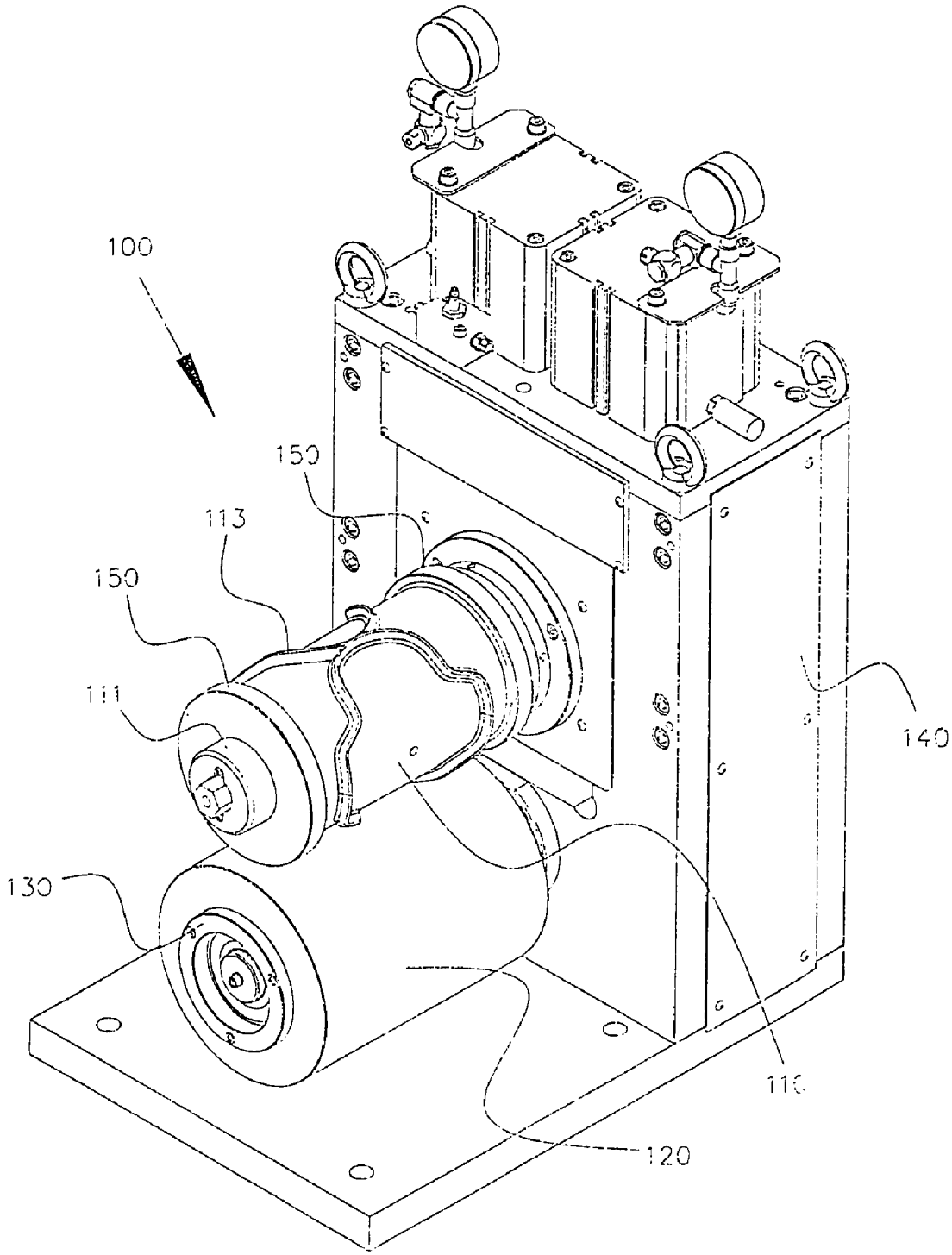
FIG. 1 shows a preferred embodiment of the device of the invention in an oblique view from the side.
Figure 2:
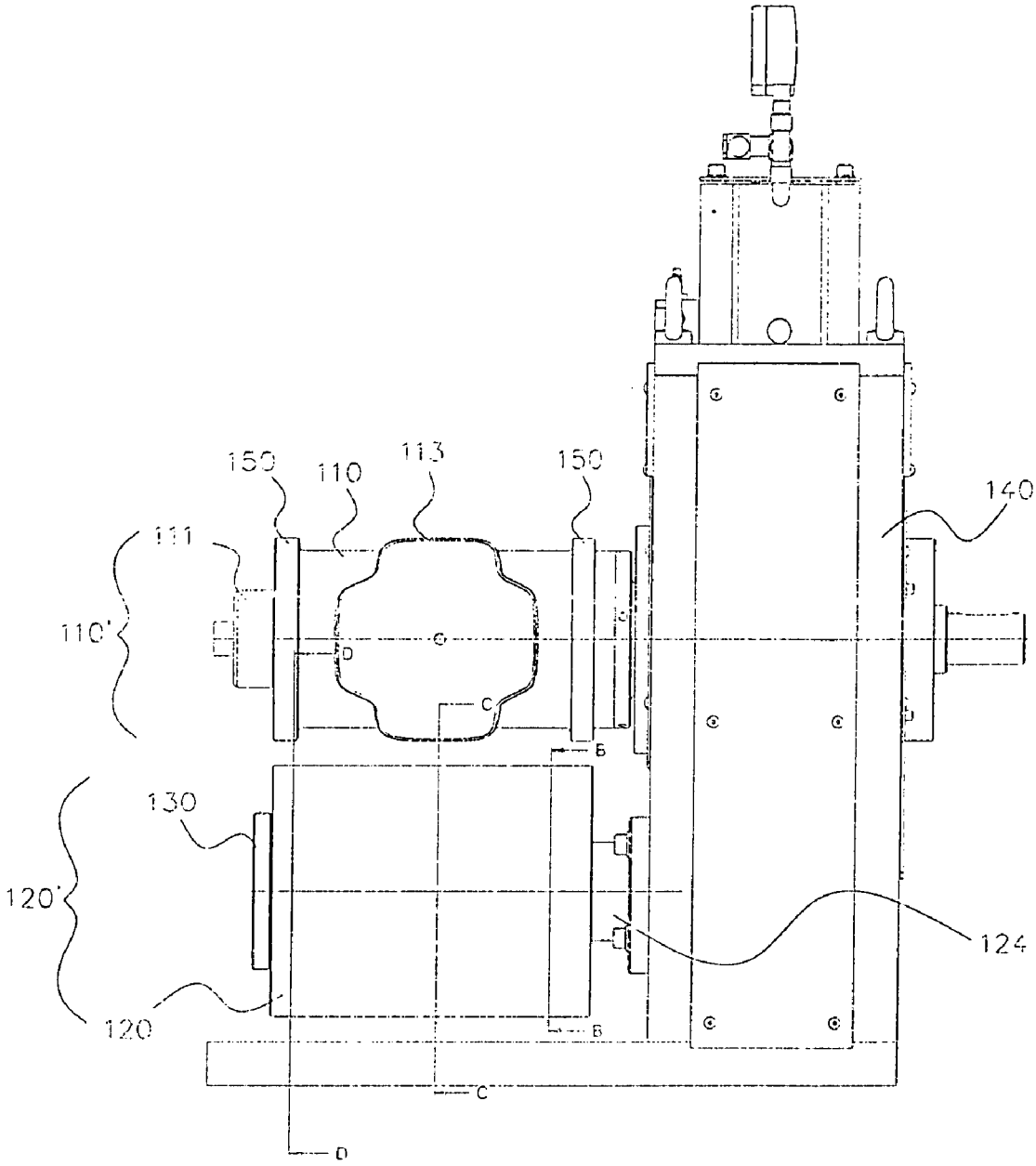
FIG. 2 is a side view of the preferred embodiment of the device of the invention shown in FIG. 1.
Figure 3:
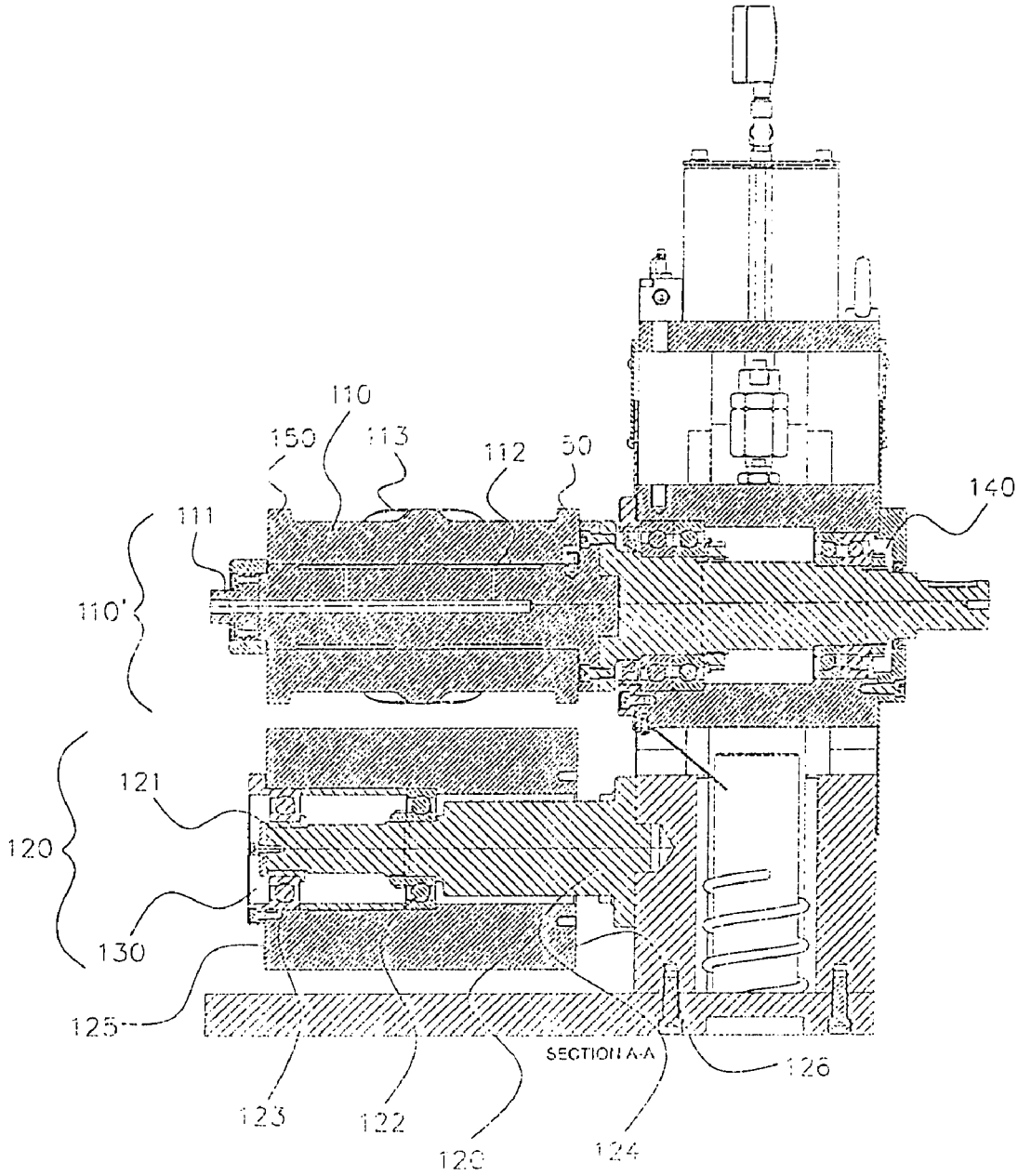
FIG. 3 is a cross-sectional view of the preferred embodiment of the device of the invention shown in FIG. 1.
Figure 4:
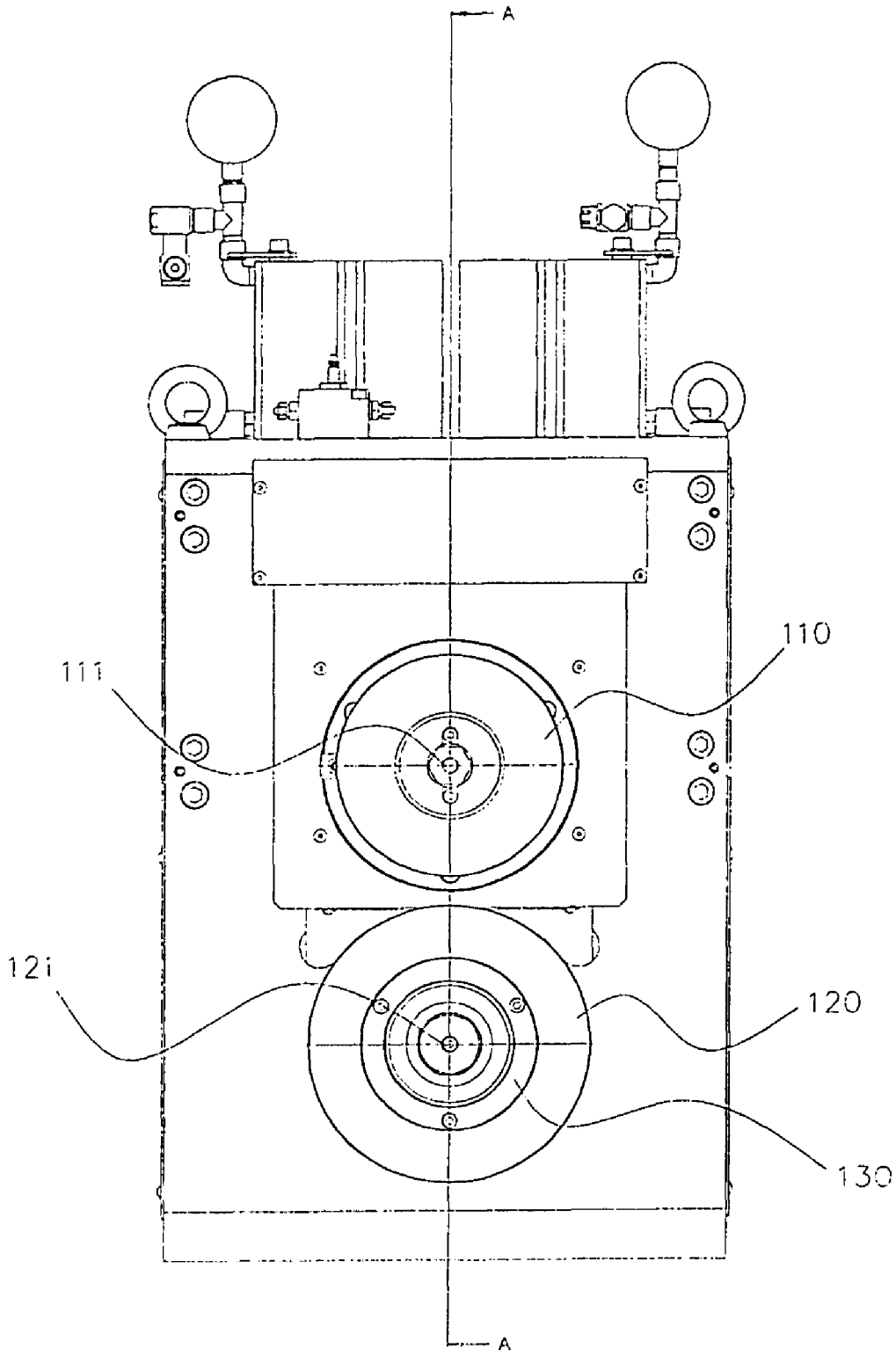
FIG. 4 is a front view of the preferred embodiment of the device of the invention shown in FIG. 1.
Figure 5:
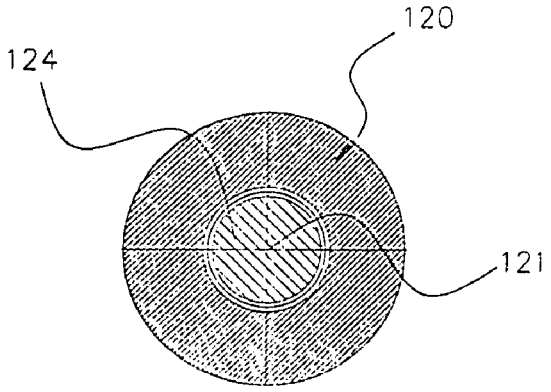
FIG. 5 is a first longitudinal section of the preferred embodiment of the device of the invention shown in FIG. 2.
Figure 6:
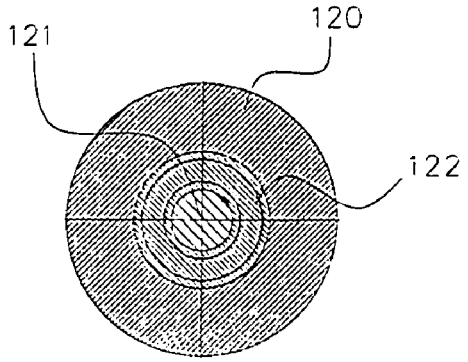
FIG. 6 is a second longitudinal section of the preferred embodiment of the device of the invention shown in FIG. 2.
Figure 7:
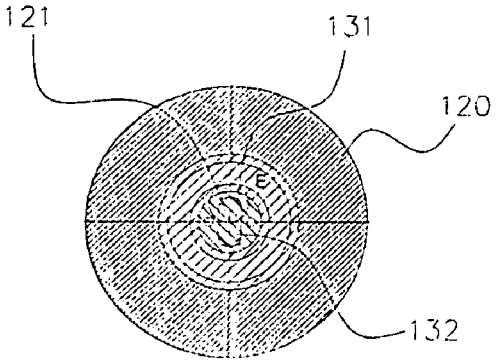
FIG. 7 is another longitudinal section of the preferred embodiment of the device of the invention shown in FIG. 2.
Figure 8:
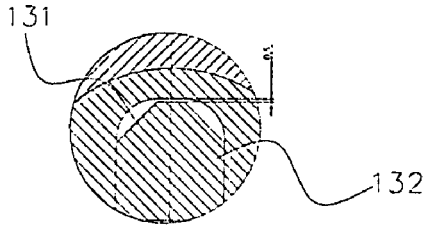
FIG. 8 is an enlarged section of a detail shown in FIG. 7.

According to the essential feature of the invention, the device 100 shown in FIGS. 1 through 8 for rotary processing of rolled materials, capable of being conveyed along a transportation path between a rotatably mounted processing sleeve 110 and a rotatably mounted anvil sleeve 120, comprises an anvil sleeve 120, which is rotatably mounted on an anvil axle 121, suspended at one end only, and which is coupled to the anvil axle 121 by means of a bearing 122 disposed in a central region midway between the opposing edges 125, 126 of the anvil sleeve 120.

Furthermore, the anvil sleeve 120 is coupled to a second bearing 123 of the anvil axle 121, which second bearing 123 is disposed in a region near a first edge 125 of the anvil sleeve 120. The second bearing 123 is provided with a pivoting mechanism 130, which enables the anvil sleeve 120 to pivot only toward the processing sleeve 110. The pivoting mechanism 130 comprises an oblong hole 131, which is oriented toward the processing sleeve 110, and in which a pin 132 connected to the anvil axle 121 is mounted such that the two lateral surfaces of the pin are flush with the lateral surfaces of the oblong hole, but the top surface of the pin is free for movement such that the first edge 125 of the anvil sleeve 120 can move toward the processing sleeve 110.

The processing sleeve 110 is disposed on a processing shaft 111, which can be driven by a motor device 140 and which is suspended at one end. The anvil axle 121 is installed in a fixed position.

The cylindrical surface of the processing shaft 111 contains a cavity 112, which is filled with a hydraulic fluid. The pressure of the hydraulic fluid against at least a part of the cylindrical surface can be adjusted for the purpose of causing a reversible expansion of the diameter of the processing shaft 111, in order to allow for detachable mounting of the processing sleeve 110 on the processing shaft 111. The pressure of the hydraulic fluid can be adjusted by a set screw, by means of which it is possible to change the unexpanded internal volume of the cavity 112 filled with hydraulic fluid.

The unit 110' consisting of the processing shaft 111 and the processing sleeve 110 is mounted for reciprocatory movement in the direction of the unit 120' consisting of the anvil axle 121 and the anvil sleeve 120, and it is possible to pneumatically control the movement of the unit 110' consisting of the processing shaft 111 and the processing sleeve 110 in relation to the unit 120' consisting of the anvil axle 121 and the anvil sleeve 120.

The anvil sleeve 120 is driven by the processing sleeve 110, the region of the front surface of the processing sleeve 110 being provided with a raceway 150, which can be brought into contact with the cylindrical surface of the anvil sleeve 120.

The processing sleeve 110 has cutting elements 113 in the region of its cylindrical surface to exert a cutting action on the rolled materials.

The exemplary embodiment of the invention described above serves merely to provide a better understanding of the teaching of the invention defined in the claims and is not, as such, restricted to said embodiment.

The invention claimed is:

1. A device for rotary processing of rolled material, the device comprising: a rotatably mounted processing sleeve;

an anvil axle suspended at one end only of said anvil axle;

a first bearing mounted on said anvil axle;

an anvil sleeve having a first edge and a second edge opposing said first edge, said anvil sleeve being rotatably mounted on and coupled to said anvil axle via said first bearing;

a second bearing coupled to said anvil sleeve and disposed on said anvil axle in an edge region near said first edge of said anvil sleeve; and a pin connected to said anvil axle and having a top surface;

wherein said first bearing is mounted in a central region of said anvil sleeve mid-way between the first edge of said anvil sleeve and the second edge of said anvil sleeve;

wherein a transportation path for rolled material is formed between said rotatably mounted processing sleeve and said anvil sleeve;

wherein said second bearing comprises a pivoting device, said pivoting device enabling pivoting of said anvil sleeve toward said rotatably mounted processing sleeve only;

wherein said pivoting device comprises an oblong hole oriented toward said rotatably mounted processing sleeve, said oblong hole having lateral surfaces;

wherein said pin is disposed in said oblong hole and is flush with said lateral surfaces of said oblong hole; and wherein said top surface of said pin is free for movement such that said first edge of said anvil sleeve is movable toward said rotatably mounted processing sleeve.

2. The device according to claim 1, further comprising a processing shaft and a motor device;

wherein said rotatable mounted processing sleeve is disposed on said processing shaft; and wherein said processing shaft is adapted to be driven via said motor device.

3. The device according to claim 2, wherein said processing shaft is suspended at one end only.

4. The device according to claim 1, wherein said anvil axle is installed in a fixed position.

5. The device according to claim 2, wherein said anvil axle is installed in a fixed position;

wherein said processing shaft comprises a cylindrical surface and a cavity filled with a hydraulic fluid in a cylindrical surface region of said cylindrical surface;

wherein said hydraulic fluid provides pressure against at least a portion of said cylindrical surface;

wherein said pressure is adjustable; and wherein by adjusting said pressure a diameter of said processing shaft is reversibly expandible and said rotatably mounted processing sleeve is detachable from said processing shaft.

6. The device according to claim 5, further comprising a set screw;

wherein said pressure of said hydraulic fluid is adjustable with said set screw; and wherein said set screw allows an unexpanded internal volume of said cavity to be changed.

7. The device according to claim 2, wherein said processing shaft and said rotatably mounted processing sleeve are movable in a reciprocatory manner in a direction of said anvil axle and said anvil sleeve.

8. The device according to claim 7, wherein a movement in said reciprocatory manner of said processing shaft and said rotatably mounted processing sleeve in said direction of said anvil axle and said anvil sleeve is pneumatically controllable.

9. The device according to claim 1, wherein said anvil sleeve is driven by said rotatably mounted processing sleeve;

wherein said rotatably mounted processing sleeve comprises a raceway in an end face region of said rotatably mounted processing sleeve; and wherein said raceway is capable of being brought into contact with a lateral surface of said anvil sleeve.

10. The device according to claim 1, wherein said rotatably mounted processing sleeve comprises cutting elements in a cylindrical surface region of said rotatably mounted processing sleeve.

* * * * *

UNITED STATES PATENT AND TRADEMARK OFFICE

CERTIFICATE OF CORRECTION

PATENT NO. : 7,971,525 B2
APPLICATION NO. : 11/918203
DATED : July 5, 2011
INVENTOR(S) : Leins It is certified that error appears in the above-identified patent and that said Letters Patent is hereby corrected as shown below:

In particular, Column 4, line 21 (Line 3 of Claim 2) after the word "said", please change "rotatable" to correctly read: --rotatably--.

Signed and Sealed this
Sixteenth Day of August, 2011

David J. Kappos

David J. Kappos
*Director of the United States Patent and Trademark Office*